US007407396B2

(12) United States Patent
Dillon et al.

(10) Patent No.: US 7,407,396 B2
(45) Date of Patent: Aug. 5, 2008

(54) LEVER ACTION MECHANICAL ASSIST CONNECTOR

(75) Inventors: Christopher Dillon, Farmington Hill, MI (US); Ping Chen, Farmington Hill, MI (US)

(73) Assignee: JST Corporation, Farmington Hills, MI (US)

( * ) Notice: Subject to any disclaimer, the term of this patent is extended or adjusted under 35 U.S.C. 154(b) by 0 days.

(21) Appl. No.: 11/203,405

(22) Filed: Aug. 15, 2005

(65) Prior Publication Data

US 2006/0051993 A1 Mar. 9, 2006

Related U.S. Application Data

(60) Provisional application No. 60/601,122, filed on Aug. 13, 2004.

(51) Int. Cl.
*H01R 13/62* (2006.01)

(52) U.S. Cl. ..... 439/157

(58) Field of Classification Search ..... 439/157, 439/155, 372, 160; 285/22
See application file for complete search history.

(56) References Cited

U.S. PATENT DOCUMENTS 5,174,785 A * 12/1992 Endo et al. ..... 439/489
5,328,377 A 7/1994 Saito
5,344,194 A * 9/1994 Hatagishi et al. ..... 285/26
5,368,492 A 11/1994 Hayashi
5,425,654 A 6/1995 Colleran et al.
5,427,539 A 6/1995 Saito
5,427,540 A 6/1995 Taguchi
5,476,390 A 12/1995 Taguchi et al.
5,513,997 A 5/1996 Taguchi et al.
5,545,047 A 8/1996 Okada et al.
5,603,624 A 2/1997 Taguchi et al.
5,810,612 A 9/1998 Flask et al.
6,254,414 B1 7/2001 Sawayanagi et al.
6,439,902 B1 8/2002 Cole et al.
6,565,372 B2 5/2003 Bakker et al.
6,655,971 B2 * 12/2003 Maegawa ..... 439/157
6,739,889 B1 5/2004 Daggett et al.
7,052,294 B1 * 5/2006 Osada ..... 439/157
2004/0147158 A1 7/2004 Hobbs et al.

* cited by examiner

*Primary Examiner*—Alexander Gilman
(74) *Attorney, Agent, or Firm*—Joseph Parisi; Nixon Peabody, LLP

(57) ABSTRACT

A lever-type electrical connector assembly employs a pivoting lever arm to assist in securely mating and un-mating connector halves with reduced connection mating forces between the halves. The assembly employs a housing with a boss pin and a connector with a corresponding cam groove. The connector includes a lever arm with which to direct the necessary mating forces. The lever arm engages the boss pin in the cam groove based upon a stroke, and the boss pin travels through the center point of rotation of the cam groove. The present invention also provides a lever-lock mechanism to securely prepare the lever arm connector in a pre-lock position. The lever lock mechanism is then automatically deflected by the base housing to enable free rotation. Once the lever arm is fully rotated and the connector halves are fully mated, a connector lock mechanism secures the connection.

14 Claims, 7 Drawing Sheets

LEVER ACTION MECHANICAL ASSIST CONNECTOR

CROSS-REFERENCE TO RELATED APPLICATIONS

This non-provisional application claims benefit of priority to provisional application Ser. No. 60/601,122 filed on Aug. 13, 2004. The disclosures of that provisional application and others referenced in the provisional application are incorporated in this application by reference.

FIELD OF THE INVENTION

The invention relates generally to electrical connector assemblies. More particularly, the invention relates to an electrical connector assembly with a pivoting lever arm mechanism to securely mate and un-mate the connectors with reduced mating force while preventing the inadvertent release of the connectors and misalignment during mating.

BACKGROUND OF THE INVENTION

Electrical connector assemblies used in automotive and other applications often employ a large number of terminals and therefore require a large mating force to ensure a secure connection between the male and female connectors. Significant frictional forces from the terminals and housings must be overcome to properly join the connectors. Similarly, in order to properly function in the environment for which they were created, the male and female connectors must be secured to ensure the electrical connection does not become disengaged, thereby opening the electrical circuit.

Conventional electrical connectors have employed locking devices consisting of screws, springs, detents, clasps, bayonet mechanisms, and other means to assist in securing electrical connectors and preventing accidental uncoupling. However, many of these locking means have been unwieldy and often physically extend beyond the primary geometric bounds of the electrical connector package. The large geometry of previous connectors have prevented their use in constrained spaces.

Previous lever assist mechanisms have used a rotating cam on one half of the connector assembly and pins or cam followers on the other half of the assembly. The distance of the contour of the camshaft to the center point of rotation changes, drawing the connector halves together by rotating the cam so that the pin follows the contour of the cam groove. A mechanical advantage is realized from utilizing a longer distance from the lever to the center rotation point than the distance from the point of contact on the pin in the cam groove to the center point of rotation.

Tangential forces are applied to the pins in the radial direction with respect to the rotation point and require a long path of travel about the cam's center point of rotation. Conventional cam and cam follower connector assemblies often require at least ninety degrees of rotation to fully mate or un-mate the connector halves.

While such methods of securing electrical connectors have been employed in the past, problems occur when the connectors are not properly aligned prior to applying the mating force, or when the connectors become misaligned as the mating force is applied, or when the connector locking mechanism is not properly secured. This can result from improper initial alignment of the connectors, as well as misalignment due to a fluctuating or an inconsistent applied force that results in skewing or otherwise improper closing of the locking mechanism. Additionally, the pressure angle may be difficult to control leading to a decrease in the mechanical advantage. Similarly, conventional cam mechanisms have often been unduly large and bulky because the stroke required was accommodated within the contour of the cam groove and often require a large degree of angular travel to mate and un-mate the connector assembly. Also, in typical cam-assisted connector assemblies, mating forces required to mate and un-mate connectors are not equal since pin diameter is included in one moment arm movement (e.g., mating) and not the other movement (e.g., un-mating). Prior attempts to overcome these challenges have fallen short in suitably addressing all concerns simultaneously. That is, there is a lack of a suitable locking mechanism that may be used to securely fasten and unfasten an electrical connector assembly employing large mating forces while preventing unintentional separation of the assembly with the stroke of the mechanical assist mechanism constrained within the contours of the cam and utilizing a relatively small amount of angular travel.

None of the previous electrical connector lever lock assemblies allow the use of large mating forces required to properly join male and female multi-pin connector structures while adequately preventing the unintentional release of the lever lock connector and providing a lever locking mechanism that operates with a mechanical stroke within the geometric projection of the cover housing used to actuate proper connection of the halves of the electrical connector assembly to provide an efficient and reliable means of mating and locking the connector assembly.

What is needed is a new type of electrical connector lever lock assembly that permits application of suitably large mating forces during the mating process while providing a compact lever arm housing and a reduced angular distance through which the arm must travel.

SUMMARY OF THE INVENTION

The present invention relates to an electrical connector assembly and method for establishing and maintaining electrical contact between conductive members to be joined by employing a lever arm mechanism and cam system to securely mate and un-mate the connectors with a reduced mating force as a lever arm is rotated. The present invention provides a lever arm connector with a cam groove to engage a cam follower projection (boss pin) of a corresponding base housing. The lever arm engages the cam follower projection (boss pin) in the cam groove based upon a stroke, and the cam follower projection (boss pin) travels through the center point of rotation of the cam groove. The present invention also provides a lever-lock mechanism to securely prepare the lever arm connector in a pre-lock position. The lever lock mechanism is then automatically deflected by the base housing to enable free rotation. Once the lever arm is fully rotated and the connector halves are fully mated, a connector lock mechanism secures the connection.

The present invention provides a simple and powerful lever lock for an electrical connector assembly to securely and confidently join male and female electrical connector structures to ensure electrical continuity and complete electrical circuits. The lever lock mechanism provides a secure and verifiable means of assuring circuit completion.

The task of securely and reliably joining multi-pin electrical connectors presents a difficult challenge as the number of pins increases and the corresponding required mating forces likewise increase. With large forces necessary, an alignment error of the male and female structures may result in inordinately high stress on individual pins resulting in cracked conductors or damaged insulators, as well as pushed pins that fail to meet and join a corresponding receptacle. Similarly, without means of ensuring the connector and housing are fully and property mated, irregular and erratic performance of the electrical connector may occur. These maladies then result in faulty or intermittent connections and greatly increase product costs as extensive troubleshooting may be required to detect the faulty assembly once the product is assembled.

No previous connector assembly employs a lever arm mechanical assist assembly for a connector where the path of travel of the cam follower (boss pin) is directly aligned to the center of the rotation cam, and the tangential force applied to the boss pin is directly applied in the angular direction of the rotation. The assembly of the present invention permits the stroke to extend beyond the cam groove profile. Since the stroke is a function of the rotating angle and the distance between the pin and the shaft, the cam may be a more compact than in previous connector assemblies. Also, with the assembly of the present invention, the pressure angle can be controlled as it is directly related to the position of the cam.

The present lever-type electrical connector assembly invention reduces the required angular travel to nearly half that of conventional cam systems. By employing the improved design of the present invention, angular travel of the shaft may be reduced to forty-five to sixty degrees. With this configuration, the angular travel distance θ will be reduced and will therefore interfere less with wires and connectors at the rear of each connector half. Additionally, mating and un-mating forces will be substantially identical.

The present invention eliminates alignment errors while simultaneously reducing the required mating forces by means of a lever arm assembly and camming system that provides a compact package with which to implement the necessary stroke for mechanical assistance in establishing an intimate electrical connection between male and female connector structures. The present invention employs a novel cam lever mechanism that results in a secure and stable connection between housing and connector structures that prevents the inadvertent release of the joined connector assembly.

The method of the present invention allows users to securely and reliably mate and lock connectors and housings with large numbers of pins and high mating forces, while at the same time preventing alignment errors, eliminating intermittent connections, and improving reliability of the overall product.

The method of the present invention is carried out using a lever arm connector comprising a shell; a lever arm with a cam groove pivotally mounted on the shell; a lever lock; and a base housing comprising a boss pin where the boss pin is engaged by the cam groove after the lever lock is deflected by the base housing. By rotating the lever arm from an open position to a closed position, the cam groove engages the boss pin thereby drawing the lever arm connector into the base housing to a connected position. An audible click, tactile feedback, or other sensory indication alerts a user that a connection has been completed.

While specific dimensions have been provided in the accompanying Figures detailing an exemplary embodiment of the present invention, one should understand that other dimensions could be employed to achieve similar satisfactory results.

BRIEF DESCRIPTION OF THE DRAWINGS

The above-mentioned and other features of this invention and the manner of attaining them will become more apparent, and the invention itself will be better understood, by reference to the following description of embodiments of the invention taken in conjunction with the accompanying figures where.

DETAILED DESCRIPTION OF THE INVENTION

The present invention relates to an electrical connector assembly and method for establishing and maintaining electrical contact between conductive members. As a lever arm is rotated, the conductive members may be joined by employing a lever action mechanical assist mechanism and cam system to securely mate and un-mate the connectors with a reduced mating force. The present invention also provides a lever lock mechanism to pre-lock the connector assembly halves in preparation for mating, to properly align the conductive members, and to prevent accidental release of the conductive members.

The present invention provides a lever action mechanical assist mechanism for an electrical connector assembly to securely and confidently join male and female electrical connector structures to ensure electrical continuity and complete electrical circuits. The lever arm mechanical assist provides a secure and verifiable means of assuring circuit completion. Likewise, the lever lock of the present invention provides an optional hold-open detent feature to safely and securely hold the connector in a pre-lock position to further prepare the conductive members for mating.

The task of securely and reliably joining multi-pin electrical connectors presents a difficult challenge as the number of pins increases and the corresponding required mating forces likewise increase. With large forces necessary, an alignment error of the male and female structures may result in inordinately high stress on individual pins resulting in cracked conductors or damaged insulators, as well as pushed pins that fail to meet and join a corresponding receptacle. Similarly, without means of ensuring the connector and housing are fully and properly mated, irregular and erratic performance of the electrical connector may occur. These maladies then result in faulty or intermittent connections and greatly increase product costs as extensive troubleshooting may be required to detect the faulty assembly once the product is assembled.

The present invention employs a lever arm mechanical assist where boss pins on one conductive member of the connector assembly are drawn into the corresponding conductive member by employing a cam design. With the lever arm mechanical assist device of the present invention, the path of travel of the boss pins are directly aligned to the center of rotation of the cam, and the tangential force applied to the boss pin is directly applied in the angular direction of rotation.

Figure 1A:
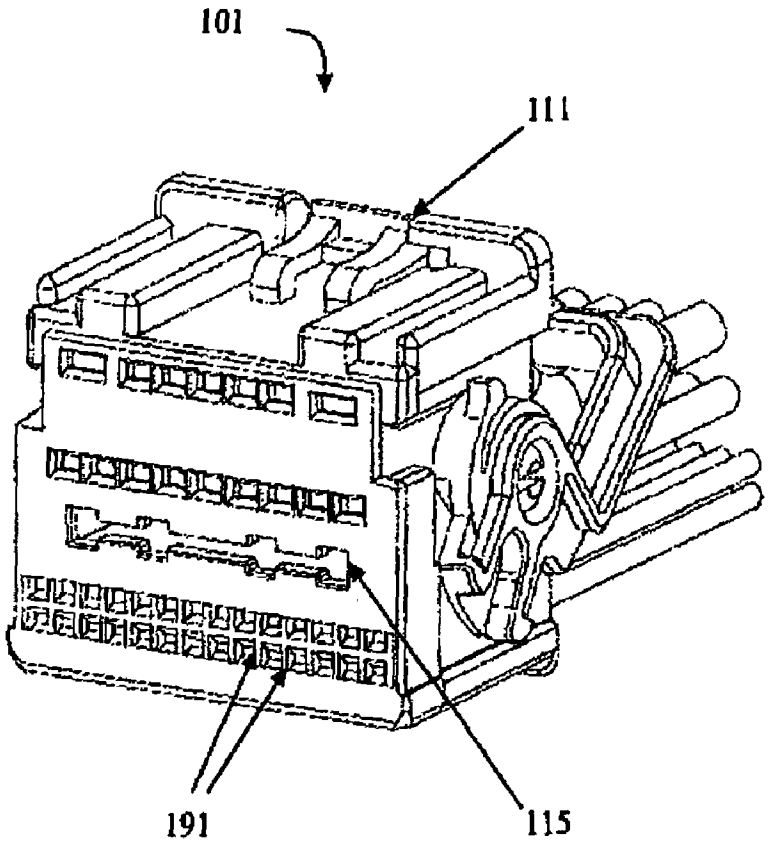
FIG. 1A is a front perspective view of a lever arm connector in accordance with the present invention showing an orientation feature of the lever arm connector.
Figure 1B:
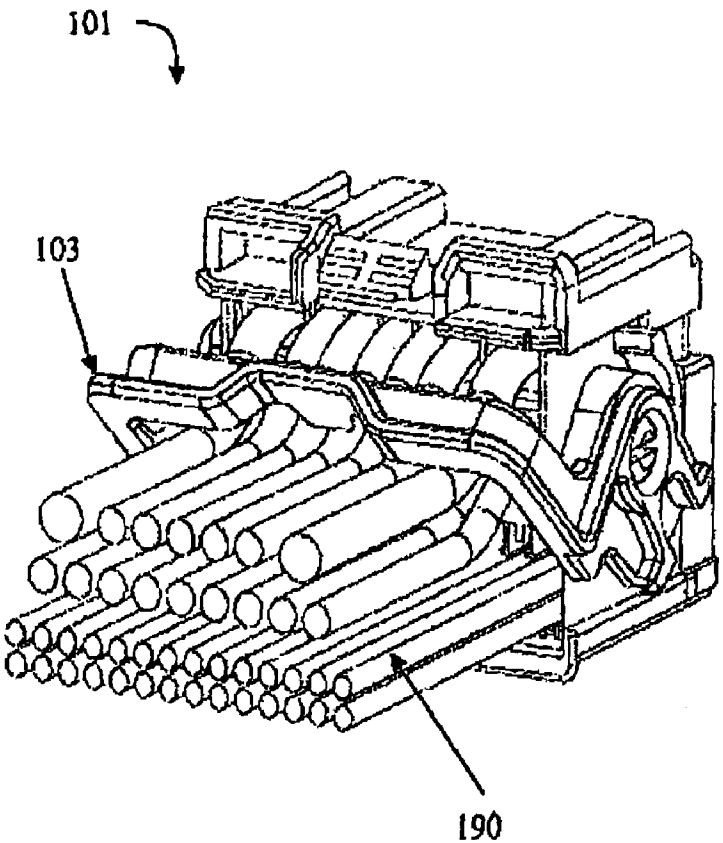
FIG. 1B is a rear perspective view of a lever arm connector in accordance with the present invention showing a manner in which wires may be routed to the rear of the lever arm connector.

Using the design of the present invention allows a compact cam because the stroke required is not limited to the cam profile. The stroke is a function of the angle of rotation and the distance between the cam follower pin and the shaft of the lever. Additionally, the present invention permits control of the pressure angle, which is directly related to the position of the cam. Further, the required angular travel distance may be greatly reduced to substantially 45 to 60 degrees. As shown in FIGS. 1A and 1B, with this reduced angular travel path, the lever will not interfere with wires 190 extending out of the connector assembly. Additionally, with the lever arm moving in an upward rotation toward connector lock 111, the invention conserves assembly space and package space alike. By moving the lever arm 103 toward connector lock 111 in the same direction of travel as lever arm connector 101, the mating forces are transferred in the same direction, thereby resulting in lower mating forces.

Figure 2:
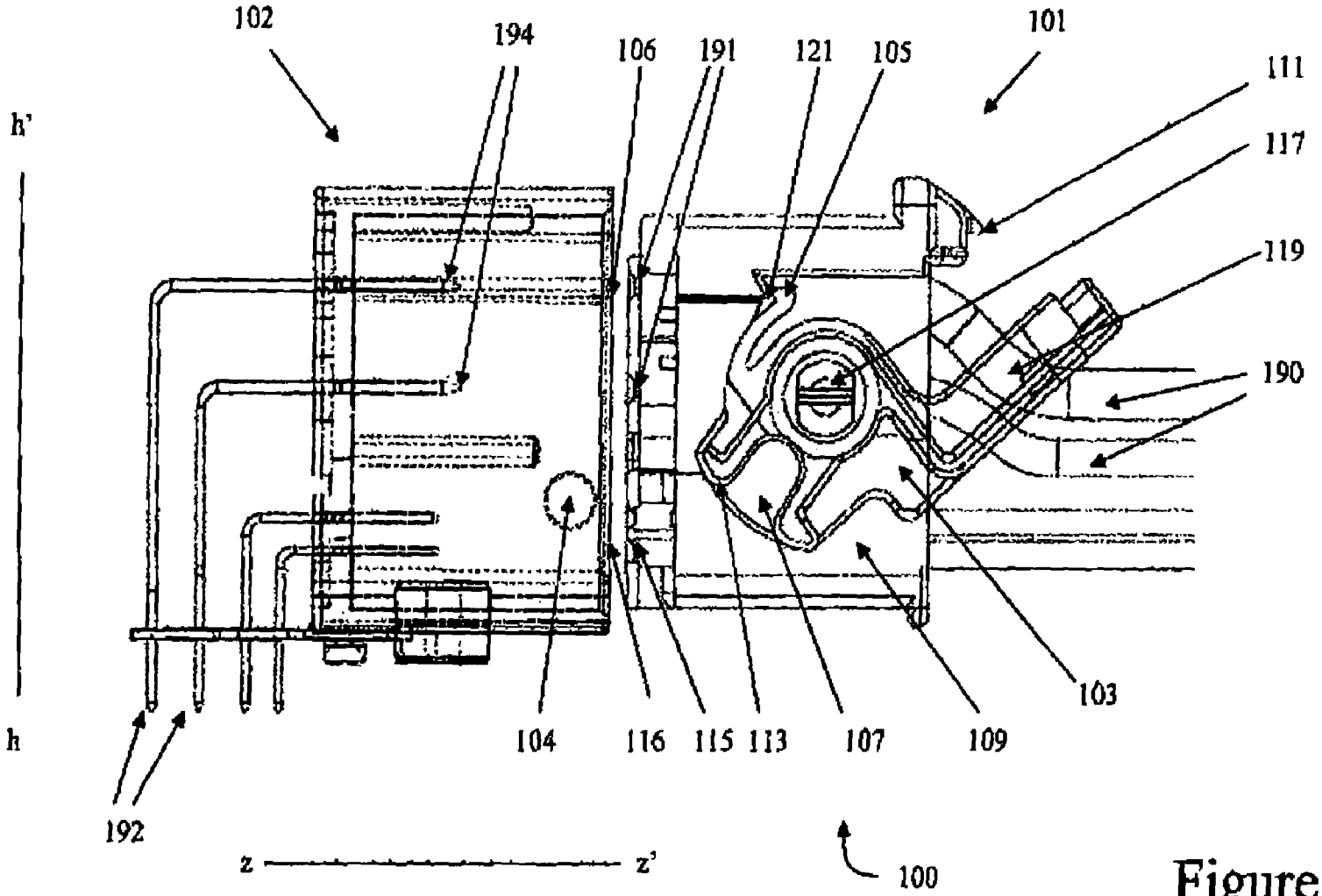
FIG. 2 is a side view of a connector assembly in accordance with the present invention showing a lever arm connector and a base housing.

FIG. 2 illustrates connector assembly 100 in a fully unmated state. It should be understood that in the following figures, lever arm connector 101 of the connector assembly 100 includes the lever arm 103 mechanical assist mechanism of the present invention, but that the individual male and female connector structures may be reversed between lever arm connector 101 and base housing 102 without changing the overall structure of connector assembly 100 of the present invention. For brevity and convenience, reference will be made to lever arm connector 101 and base housing 102 structures as depicted in FIG. 2.

FIG. 2 shows lever arm connector 101 and base housing 102. In base housing 102, electrical contact points 194 are formed through in the front-to-rear direction of base housing 102 as illustrated by directional line z'-z. The electrical contact points 194 are formed parallel to each other in several rows in the height direction of the base housing as illustrated by directional line h-h' and in several columns in the width direction of the base housing (not shown). Electric terminals 192 form the opposite side of each electrical contact point 194. Optionally, lever arm connector 101 and base housing 102 may also be lined with a flexible impervious material to prevent liquid and vapor from reaching the electrical contact points 194 when the connector assembly 100 is fully assembled.

In lever arm connector 101, chambers 191 are formed in a reciprocal fashion to accommodate the type of electrical contact point 194 utilized in base housing 102. The electrical contact points 194 may be made in any number of ways, including, but not limited to blade terminals, pin terminals, block terminals, edge connectors, and the like, as long as the chambers 191 on lever arm connector 101 and electrical contact points 194 on base housing 102 form the two halves of the physical junction that join to complete an electrical circuit. Chambers 191 may be arranged in parallel rows and columns as shown in FIG. 1A, or in any fashion to accommodate the joining of electrical contact points 194 on base housing 102.

Returning to FIG. 2, base housing 102 also includes boss pin 104. Similarly, a corresponding boss pin is present on the opposite side (not shown) of base housing 102, so that there is a pair of boss pins on base housing 102. Base housing 102 further includes a lever lock deflector 106 that extends in the z'-z direction on the outside portion of base housing 102. Lever lock deflector 106 is used to move lever lock 105 from an engaged position (that is, engaged with lever lock detent 121) to a rotating position by deflecting lever lock 105 away from the lever lock detent 121, thereby permitting rotation of the lever arm 103 and engagement of boss pin 104 by cam groove 107.

Lever arm connector 101 forms the reciprocal side of connector assembly 100 and is used in conjunction with base housing 102. Lever arm 101 comprises shell 109 made of an insulating material and lever arm 103. Connector lock 111 is formed as part of lever arm connector shell 109 and may be used to secure lever arm 103 in a fully-locked, connected position. Lever arm 103 includes lever lock 105 with which lever arm 103 may be secured in a pre-lock position to mate with base housing 102. Lever arm 103 is pivotally mounted on lever arm pivot shaft 117 of the connector shell 109. Lever arm 103 further includes cam groove 107 with which to engage boss pin 104 of base housing 102. Cam groove 107 includes an eccentric receiving portion 113 that is tapered outward slightly at the edge of the lever arm 103 to facilitate receiving boss pin 104 when lever arm connector 101 and base housing 102 are mated.

Lever lock 105 extends from lever arm 103 and is connected to at least one end of lever arm 103. For example, as shown in FIG. 2, lever lock 105 may be formed as a projection of lever arm 103. The structure of lever lock 105 enables an elastic response when lever arm 105 is deflected by lever lock deflector 106. Lever lock 105 is substantially opposite lever arm boom 119 of lever arm 103 such that as lever arm boom 119 is raised upward in the h-h' direction toward connector lock 111, lever lock 105 moves downward in the h'-h direction away from connector lock 111. In the pre-lock position illustrated in FIG. 2, lever lock 105 is shown engaged in lever lock detent 121. The significance of this engagement is discussed further with regard to FIGS. 3A and 3B.

As also illustrated in FIG. 1A and FIG. 2, lever arm connector 101 may also include one or more lever arm orientation features 115 such as keys or slots, for example, that serve to geometrically distinguish the orientation of lever arm connector 101. Likewise, base housing 102 may include a corresponding base housing orientation feature 116 that correspondingly serves to geometrically distinguish the orientation of base housing 102. By matching lever arm orientation feature 115 with base housing orientation feature 116, an accurate and reliable connection between lever arm connector 101 and base housing 102 may be made.

FIG. 2 illustrated connector assembly 100 in a fully open state, where the lever arm connector 101 and base housing 102 are separate and have yet to be joined. FIG. 2 shows lever arm connector 101 in a pre-lock position where the lever lock 105 is engaged with lever lock detent 121. In this state, lever arm boom 119 is positioned above wires 190 such that the required angular travel distance to fully mate the lever arm connector 101 to the base housing 102 is substantially 45 to 60 degrees.

Figures 3A, 3B:
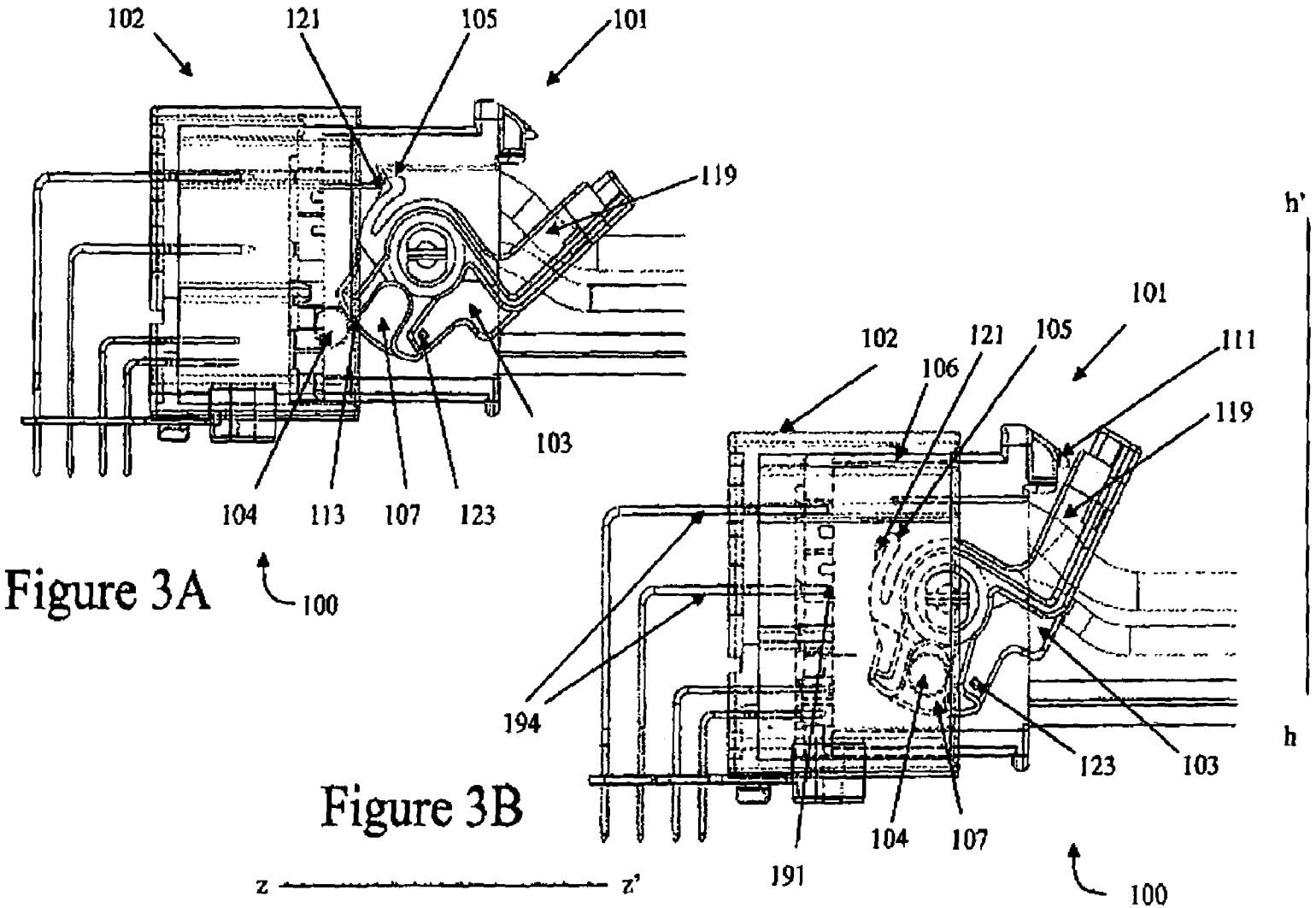
FIG. 3A is a side view of a connector assembly in accordance with the present invention illustrating a pre-lock position showing the designed interference between a boss pin and a cam groove just prior to an initial engagement.
FIG. 3B is a side view of a connector assembly in accordance with the present invention as the lever lock is deflected just after an initial engagement illustrating the designed interference between a boss pin and a cam groove.

The initial operation of the connector assembly 100 is further illustrated in FIG. 3A and FIG. 3B. FIG. 3A illustrates the connector assembly 100 in a pre-lock position showing the designed interference between boss pin 104 and eccentric receiving portion 113 of cam groove 107 just prior to an initial engagement. As further shown in FIG. 3A, cam groove 107 of lever arm 103 has an eccentric receiving portion 113 formed to accept boss pin 104 of base housing 102. A corresponding second cam groove (not shown) is formed on the opposite side of lever arm 103, and a corresponding boss pin (not shown) is formed on the opposite side of base housing 102. The two cam grooves are mirror images of each other about the center of the width of lever arm 103 just as the two boss pins are mirror images of each other about the center of the width of base housing 102.

Lever arm boom 119 is raised in the h-h' direction and brought into position as shown in FIG. 3A, thereby engaging lever lock 105 in lever lock detent 121. Optional hold-open detent 123 formed in shell 109 may further secure lever arm connector 101 in the pre-lock position. As lever arm connector 101 is inserted into base housing 102 to this pre-lock position, boss pin 104 is urged upward toward lever arm 103 at receiving portion 113 of cam groove 107. Boss pin 104 snaps into a pre-lock position (best illustrated in FIG. 3B) as it overcomes the edge of eccentric receiving portion 113 of cam groove 107 while reaching a temporary physical limit imposed by the retaining force provided by lever lock 105 and lever lock detent 121.

As shown further in FIG. 3B, as a user continues to insert lever arm connector 101 into base housing 102 beyond the pre-lock position, lever lock deflector 106 engages lever lock 105 and moves lever lock 105 from a locked position (that is, locked with lever lock detent 121) to a free rotation position where the lever arm 103 may be rotated freely since lever lock 105 is now deflected away from lever lock detent 121. Immediately after lever lock 105 is deflected, the position of electrical contact points 194 is such that they have not yet made contact with chambers 191 of lever arm connector 101. Similarly, boss pin 104, is retained in the pre-lock position until further engagement of the boss pin 104 by cam groove 107 is performed. As indicated above, a similar engagement action occurs with the mirror image boss pin and cam groove pair. As lever arm boom 119 is rotated upward toward connector lock 111, boss pin 104 is further engaged by cam groove 107, and lever arm connector 101 and base housing 102 are drawn together toward a mated position. As lever arm boom 119 is rotated upward, the initial rotation force is also used to overcome the retaining force between the shell 109 and the lever arm 103 provided by optional hold-open detent 123.

Figure 4:
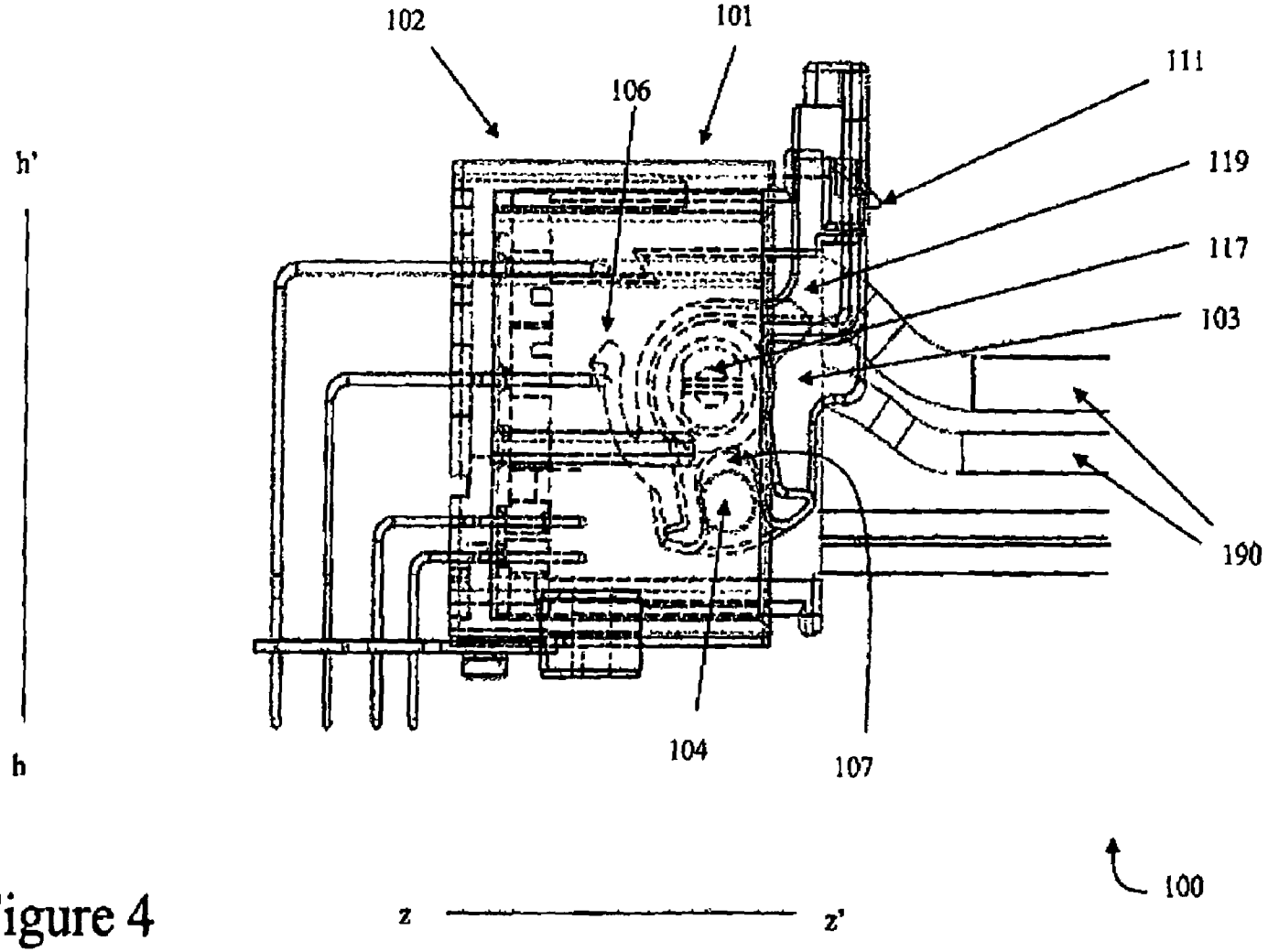
FIG. 4 shows a side view of the connector assembly in accordance with the present invention illustrating the connector assembly in a fully engaged and locked position.
Figure 5:
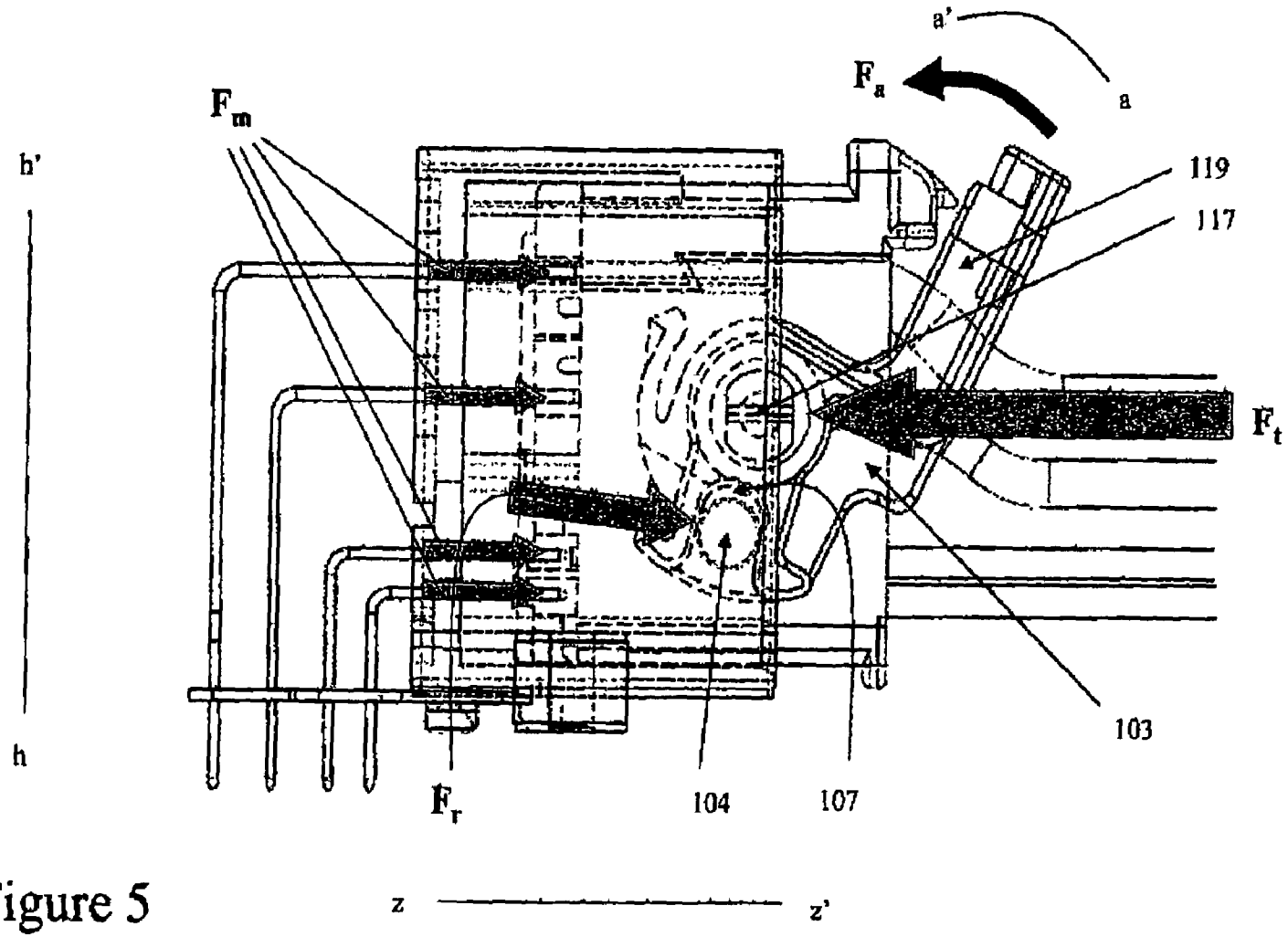
FIG. 5 shows a side view of the connector assembly in accordance with the present invention illustrating the application force of the lever arm, the mating force between the base housing and the lever arm connector, the reaction force on the boss pin, and the terminal-to-terminal mating force as a connection is made.

As shown in FIG. 4, as lever arm boom 119 is moved in the h-h' direction and reaches its full range of travel toward connector lock 111, connector lock 111 engages lever arm boom 119. Likewise, as lever arm boom 119 is moved in the h-h' direction, lever arm 103 rotates about lever arm pivot shaft 117 causing cam groove 107 to further engage boss pin 104 and exert pressure on boss pin 104 with connection mating force components $F_m$ generally in the z-z' direction as shown in FIG. 5. Pivot shaft 117 is centered on lever arm connector 101, thereby transferring the mating force of the lever arm connector 101 at the center of the connector assembly 100.

The applied force $F_a$ to rotate lever arm boom 119 along the arc of movement a-a' is also shown in FIG. 5. As discussed above, by moving the lever arm 103 toward connector lock 111 in the same direction of travel as lever arm connector 101 (that is lever arm 103 and lever arm connector 101 both move toward base housing 102), the applied force $F_a$ efficiently transfers a mating force in the same direction of movement, thereby resulting in a lower overall mating force.

Returning to FIG. 4, the camming action pressure exerted by cam groove 107 on boss pin on boss pin 104 as lever arm boom 119 is rotated toward connector lock 111 causes lever arm connector 101 to move linearly in the z'-z direction and lever arm connector 101 is drawn into base housing 102 until lever arm boom 119 encounters a mechanical stop, such as connector lock 111 illustrated in FIG. 4. Lever arm boom 119 encounters this mechanical stop corresponding to the end of the full range of angular motion of lever arm boom 119. Lever arm boom 119 and connector lock 111 meet to form a protective cover for wires 190 leading to chambers 191 in lever arm connector 101. At this point, lever arm boom 119 is in its fully closed position corresponding to the end of travel along arc a-a', and lever arm connector 101 is at the end of linear travel along the direction z'-z.

If an operator must un-mate the connector assembly, the process is reversed as connector lock 111 is depressed and lever arm boom 119 is rotated in the opposite direction toward its initial position along arc a'-a. This rotation of the lever arm 103, in turn, drives cam groove 107 against boss pin 104 and forces lever arm connector 101 to move linearly in the opposite direction along z-z' away from base housing 102. Simultaneously, as lever arm boom 119 is further rotated, the rotation and linear movement allows lever arm connector 101 to withdraw from base housing 102 and thereby disconnects electrical contact points 194 from chambers 191 thereby opening the electrical connection. When lever arm boom 119 is rotated back to its starting position, cam groove 107 has driven boss pin 104 back to its initial position as well. At this point, lever arm 103 is once again in its pre-lock position and cam groove 107 and boss pin 104 have been returned to their initial positions of travel.

Figure 6:
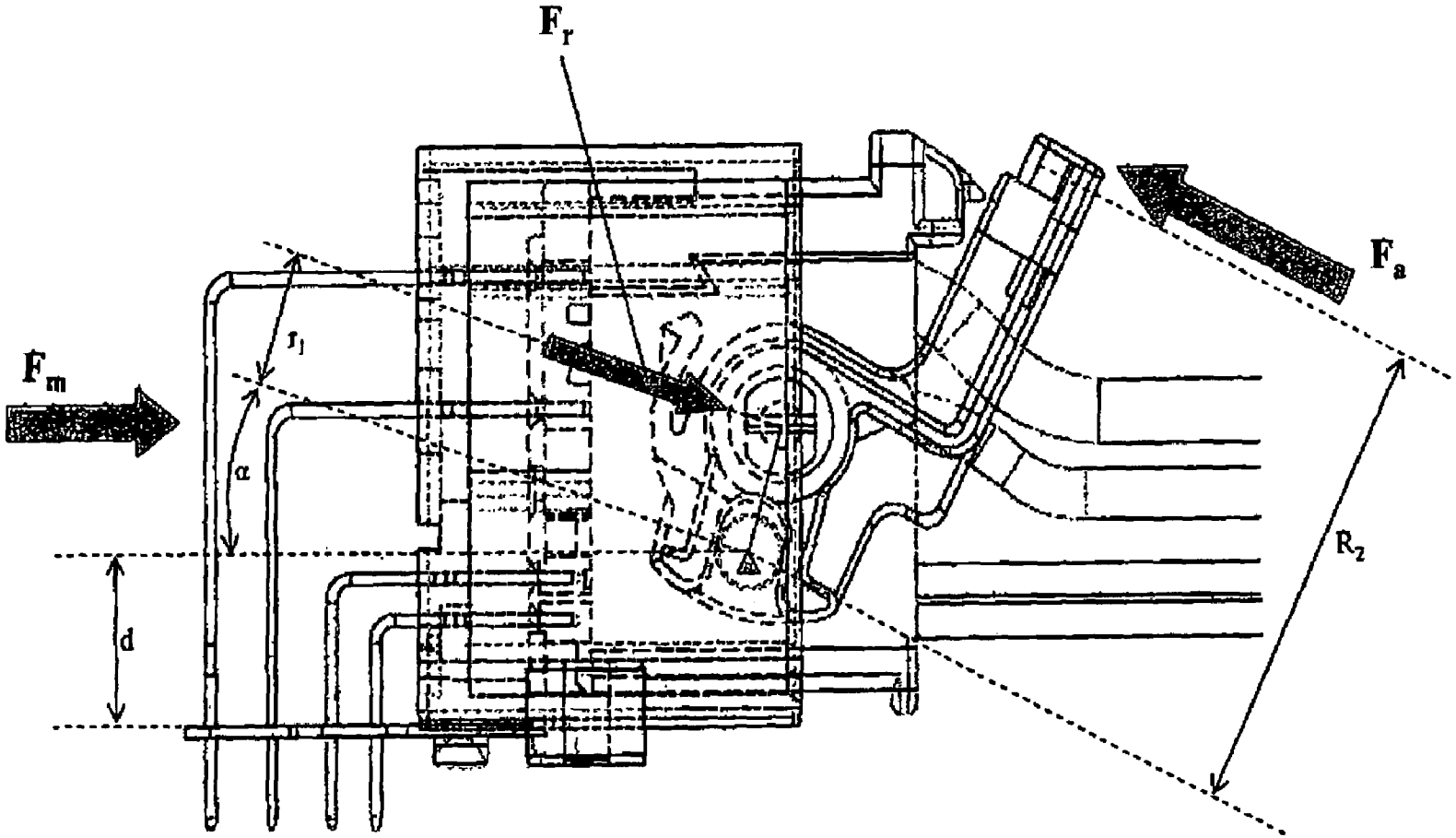
FIG. 6 shows a side view of the connector assembly in accordance with the present invention illustrating the applied force, reaction force, and connector mating force as applied to the geometry of the lever arm connector and base housing.
Figure 7:
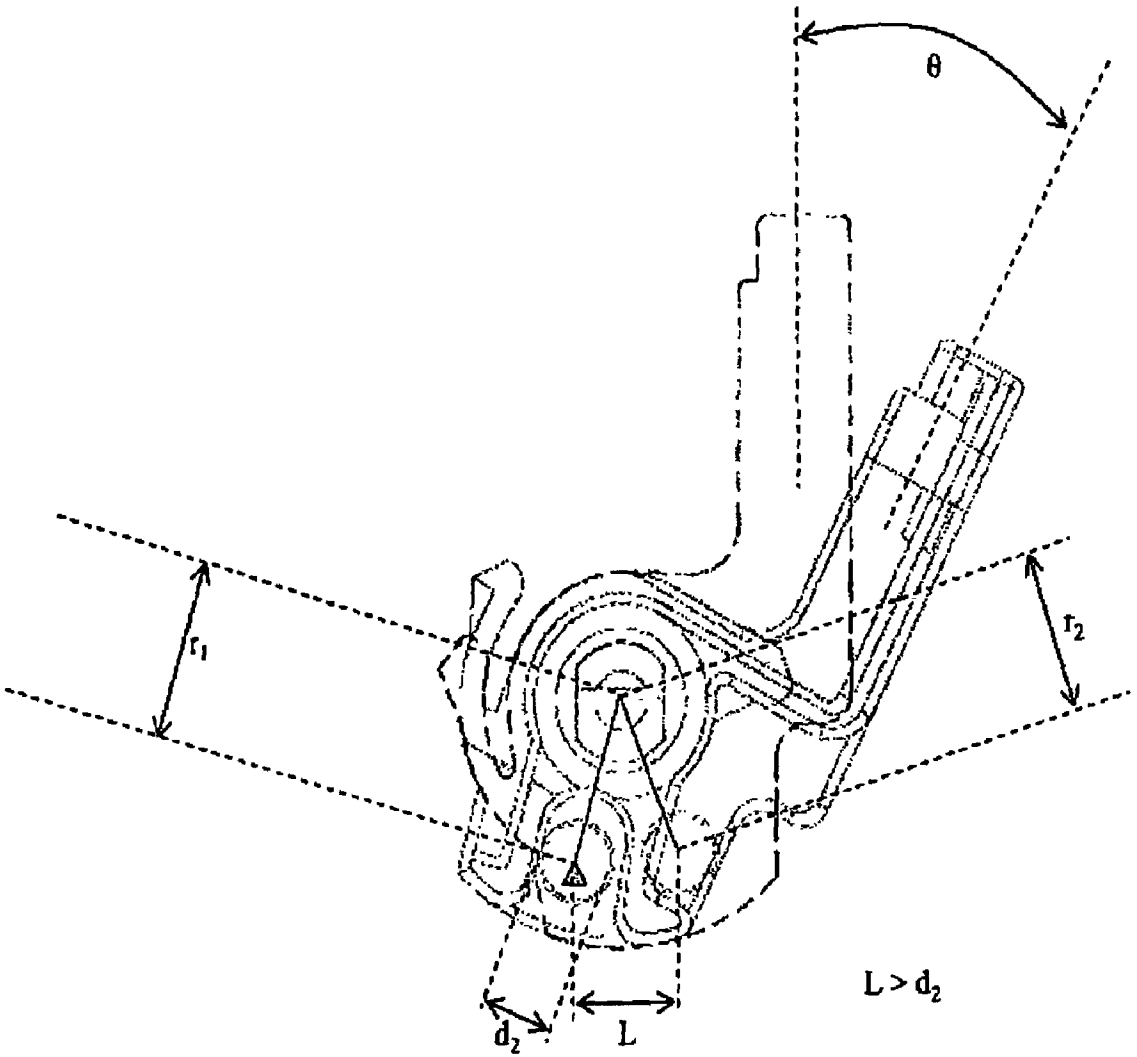
FIG. 7 shows a detailed side view of a lever arm in accordance with the present invention illustrating the relationship of the stroke as a function of the distance between the lever arm pivot shaft and the boss pin and the angular travel distance of the lever arm.

As shown in FIG. 6, the present invention permits control of the pressure angle a with increased mechanical advantage while utilizing small angular travel distances a-a' to mate and un-mate the connector. The mating forces and un-mating forces are substantially the same since distance $r_1$ remains the same regardless of the direction of travel in which lever arm 103 is rotated. The cam mechanism may be streamlined since the required stroke does not need to be accommodated within the contour of the cam as shown in FIG. 6 and FIG. 7. Additionally, by controlling the pressure angle $\alpha$, the distance d between the boss pin 104 and the bottom edge of base housing 102 may be controlled and minimized thereby resulting in a lower reaction force on the boss pin 104 and a resulting lower reaction moment on the bottom edge of the base housing 102 and a printed circuit board to which base housing 102 may be mounted.

FIG. 7 further illustrates that the stroke L is a function of distance $r_1$ and angular travel distance $\theta$. As discussed above with regard to FIG. 6, the distance $r_1$ and distance $r_2$ are substantially the same, thereby resulting in substantially the same mating and unmating force. Since the angular travel distance $\theta$ is reduced to substantially 45 to 60 degrees, stroke L is not constrained to the contour of the cam groove 107 and may be greater than the distance of the cam groove profile $d_2$.

In addition to the exemplary embodiment described above, additional features include a radically curved and/or off-set initial inlet (eccentric receiving) portion for the cam groove to aid in the initial engagement of the boss pin to the cam groove. A radical curved arrangement and/or an off-set arrangement results in a further reduced pressure angle a at the pre-lock position. Additionally, in additional embodiments, the path of travel of the boss pin may be non-linear by incorporating an asymmetrical cam groove with which to engage the boss pin.

By altering the geometry of the boss pin and cam groove engagement, the pressure angle may be reduced, the applied force may be reduced, and the reaction force on the lever arm may also be reduced depending upon the particular application.

The method of the present invention allows users to securely and reliably mate and lock connectors and housings with large numbers of pins and high mating forces, while at the same time preventing alignment errors, eliminating intermittent connections, and improving reliability of the overall product.

While the present invention have been described in connection with a number of exemplary embodiments and implementations, the present invention is not so limited but rather covers various modifications and equivalent arrangements, which fall within the purview of the appended claims.

What is claimed is:

1. A lever-type electrical connector that reduces connector mating forces and alignment errors, the connector comprising:

a base housing including a boss pin; and a lever arm connector to mate to the base housing, the lever arm connector including:

a lever arm having a lever arm boom and a cam groove, said cam groove having opposing cam surfaces positioned substantially parallel to the lever arm boom to engage the boss pin of the base housing thereby providing controlled clearance to the boss pin resulting in controlled connection backlash, wherein the lever arm engages the boss pin in the cam groove based upon a stroke, and the boss pin travels through the center point of rotation of the cam groove and a tangential force is applied to the boss pin in the angular direction of rotation, thereby transferring a mating force to the base housing in the same direction of movement.

2. The lever-type electrical connector of claim 1, wherein the lever arm connector further comprises a hold-open detent.

3. The lever-type electrical connector of claim 1, wherein the cam groove includes an eccentric receiving portion.

4. The lever-type electrical connector of claim 1, wherein the lever arm connector further comprises an orientation feature.

5. The lever-type electrical connector of claim 1, wherein the base housing further comprises a base housing orientation feature.

6. The lever-type electrical connector of claim 1, wherein the path of travel of the boss pin is directly aligned to the center point of rotation thereby extending the stroke beyond the cam groove profile.

7. The lever-type electrical connector of claim 6, wherein the distance of the stroke is greater than the distance of the cam groove profile.

8. The lever-type electrical connector of claim 6, wherein the mating force and an un-mating force are substantially the same.

9. The lever-type electrical connector of claim 1, wherein the lever arm connector further comprises a lever lock to hold the lever arm connector in a pre-lock position.

10. The lever-type electrical connector of claim 9, wherein the base housing further includes a lever lock deflector to deflect the lever arm lock to enable the lever arm connector to rotate and to further enable the cam groove to engage the boss pin to draw the lever-type electrical connector to a mated position.

11. The lever-type electrical connector of claim 10, wherein the lever lock is formed as a projection of the lever arm to provide an elastic response as the lever lock deflector deflects the lever lock.

12. The lever-type electrical connector of claim 1, wherein the lever arm has a range of angular travel less than 60 degrees.

13. The lever-type electrical connector of claim 12, wherein the angular travel of the lever arm is in the same direction as the linear travel of the lever arm connector.

14. The lever-type electrical connector of claim 13, wherein the lever lock connector further comprises a connector lock with which to engage the lever arm at the end point of the angular travel of the lever arm, thereby securing the lever arm in the connector lock as the lever arm connector and the base housing are mated.

* * * * *